United States Patent [19]

Allen

[11] Patent Number: 4,462,190

[45] Date of Patent: Jul. 31, 1984

[54] FLASHING PRODUCT

[75] Inventor: Ronald J. Allen, Geneva, Ill.

[73] Assignee: Illinois Tool Works Inc., Chicago, Ill.

[21] Appl. No.: 518,165

[22] Filed: Jul. 28, 1983

[51] Int. Cl.[3] ..... E04D 1/36; E04D 3/38; B32B 3/04

[52] U.S. Cl. ..... 52/58; 428/99; 428/121; 428/126

[58] Field of Search ..... 428/99, 121, 124, 130, 428/83, 126, 127, 128, 129; 52/58, 60

[56] References Cited

U.S. PATENT DOCUMENTS

| | | | |
|---|---|---|---|
| 1,062,091 | 5/1913 | Foster | 52/60 |
| 1,813,084 | 7/1931 | Robinson | 428/126 |
| 1,822,410 | 9/1931 | Macan | 428/126 |
| 2,499,908 | 3/1950 | Figge | 52/60 |
| 2,713,017 | 7/1955 | Bruns | 428/124 |
| 3,172,236 | 3/1965 | Weckerly et al. | 52/58 |
| 3,312,585 | 4/1967 | Hamme | 428/126 |
| 3,581,450 | 6/1971 | Patry | 52/58 |
| 4,241,121 | 12/1980 | O'Connor | 428/124 |
| 4,282,050 | 8/1981 | Thiis et al. | 428/99 |
| 4,333,660 | 6/1982 | Cupit | 52/60 |

*Primary Examiner*—William J. Van Balen

*Attorney, Agent, or Firm*—Thomas W. Buckman; David I. Roche

[57] ABSTRACT

A flashing system including a fiber reinforced silicone sheet having substantial vapor permeability and water resistance is pre-assembled with a pair of ductile non-corrodable strips embedded in edges of the sheet. The system also includes the use of headed self-drilling fasteners to facilitate installation in metal buildings and to create a seal at the point of fastening.

12 Claims, 5 Drawing Figures

FLASHING PRODUCT

BACKGROUND AND SUMMARY OF THE INVENTION

The present invention relates to flashing, and in particular to flashing for use with structures having irregular surfaces near locations requiring sealing.

The increased use of sheet metal in building constructions, particularly with respect to roofing, has required changes in the ways such structures are made waterproof. The use of thin sheet metal requires that it be generally corrugated to increase its flexural strength. The corrugations create difficult sealing problems. The irregular surfaces make rigid furring strips, traditionally use to hold sheet material in place, unusable. Even with pliable strips, the irregular surfaces of metal building make the use of separate strips and sheets difficult. Another difficulty is the weathering of exposed strips, and the susceptability of such strips to leaks at points where they are fastened.

Accordingly it is an object of the present invention to provide a flashing system which prevents water from entering metal buildings.

Another object is to provide a flashing system which conforms to irregular surfaces.

Another object is to provide a flashing system which is easily handled during installation.

Another object is to provide a flashing system which is easily fastened to a structure.

Another object is to provide a flashing product which prevents water entry into a structure at points where the flashing is attached to the structure.

These and other objects and advantages are achieved with a pre-assembled flashing which includes a rubbery water resistent sheet material. The edges of the sheet are folded over a pair of ductile strips which run parallel to the length of the sheet. The strips may be perforated to facilitate the proper location of self drilling fasteners used to attach the flashing to a structure. When the head of a fastener contacts the flashing, a seal is formed because of the resilient characteristics of the rubbery sheet. The sheet material is preferably made of a fiber reinforced silicone rubber which is both strong and durable.

DETAILED DESCRIPTION OF THE DRAWINGS

DETAILED DESCRIPTION OF THE INVENTION

Figure 1:
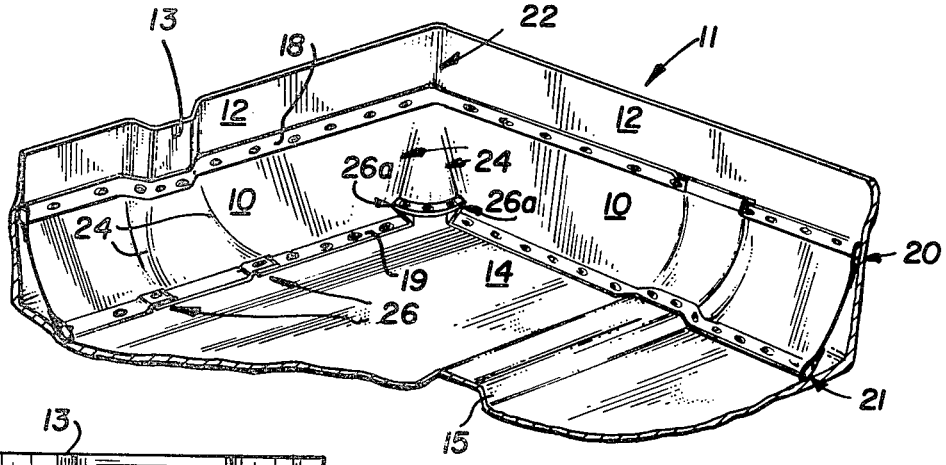
FIG. 1 is a perspective view of a portion of a structure having a flashing system of the present invention.

FIG. 1 shows an over-all view of the flashing system of the present invention. An elongated sheet 10 is placed at the intersection of a vertical panel 12 and a horizontal panel 14 which are part of a structure 11. Fasteners, preferably screws, 16 are used to attach the edges 18 and 19 of the sheet 10 to the structure 11. The panels 12 and 14 each have corrugations 13 and 15, respectively. The edges 18 and 19 have a ductile strip 20 and 21 embedded therein. The ductile strips are able to be easily bent to conform to the corrugations 13 and 15 and the corner 22 of the vertical panels 12. Pleats 24 are created by folding portions of the edges 18 and 19 upon themselves to form laps 26 on the edge opposite the corrugation. Similarly angled laps **26*a* are formed at the lower edge 19 to take up slack in the sheet due to the shorter path taken by the lower edge 19** when installing flashing in an inner corner. It should be noted that if the flashing is installed on outer corners, the upper edge will need to be lapped and pleated since the upper edge will have a shorter path.

Figure 2:
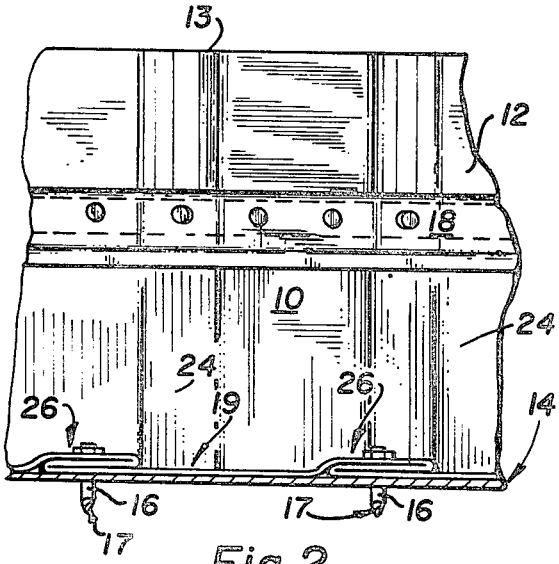
FIG. 2 is an elevational view in partial section of a structure having a flushing system of the present invention.

FIG. 2 is a view showing the flashing system of the present invention in more detail. Screws 16 have drill points 17 which are adapted to penetrate the edge of the flashing and the metal panel 14. The upper edge 18 and strip 20 of the flashing sheet 10 is bent to closely conform to the corrugation 13 in the panel 12. Lap 26 and pleats 24 are formed in the sheet at the lower edge 19 to take up the slack.

Figure 3:
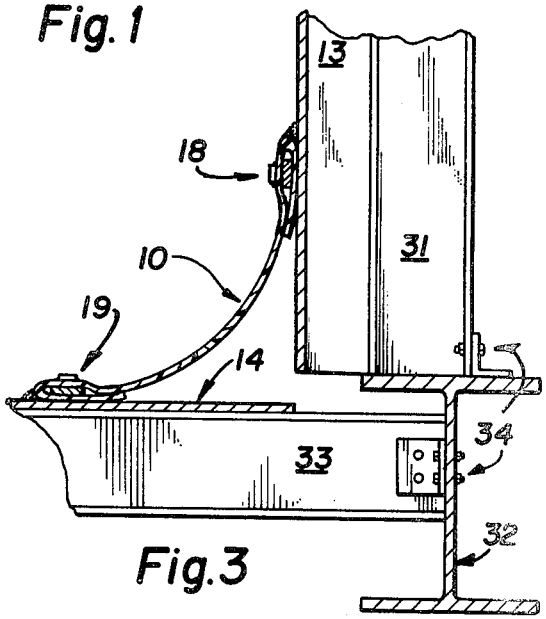
FIG. 3 is a sectional view taken along line III—III of FIG. 2.

FIG. 3 is a view showing a portion of the flashing system in section, and its relationship to structural members 31 to 33 and their connections 34. It is important in structural arrangements as shown in FIG. 3 to prevent water from gaining access to the members and more particularly to their connections 34. Even if the structural connection of the structure are not immediately accessible to moisture, it is important to keep these areas dry because water can have serious deleterious effects upon insulation and interior of finishes of buildings. For this reason, a sealant 28 is applied at the abutment of the edges 18 and 19 with the structure. In addition, the sheet 10 is made of a vapor permeable silicone rubber material to allow the evaporation of condensation which naturally occurs with changes in temperature inside the structure near the flashing and elsewhere. A thin sheet of fiber reinforced silicone 0.025 inches thick has been found to work well and has excellent vapor permeability on the order of 38 grams per square meter per day.

Figure 4:
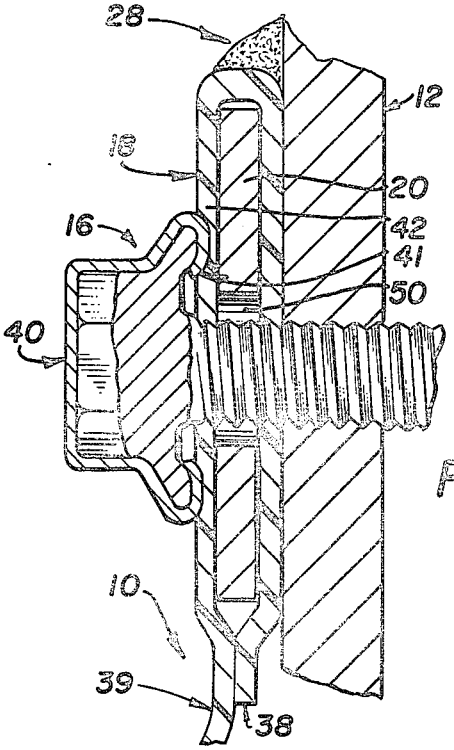
FIG. 4 is an enlarged sectional view of a fastener used to hold the flashing of the present invention.
Figure 5:
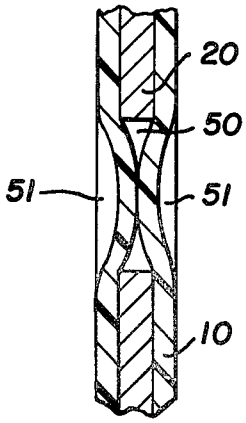
FIG. 5 is an enlarged sectional view of a preformed hole in the strip embedded in the flashing of the present invention.

FIG. 4 shows, in detail, the sealing aspects of the flashing system of the present invention. An edge of the sheet 10 is shown fastened to the panel 12. The head 40 of the fastener 16 clamps the edge 18 and because the sheet 10 is made of resiliently compressible material, the under surface 41 abuts and seals the portion 42 of the sheet 10 near the aperture 50. This prevents water from entering the structure at the point of fastening. For convenience of drilling, the strips 20 and 21 have preformed apertures 50. To aid an installer in properly spacing the fasteners, the sheet material may form a visible indentation 51 in the surface of the edge. The sealant 28 is preferably a material which is compatible with both the sheet 10 and the panel 12. A common silicone sealant has been found to perform well and adheres to both the silicone sheet and metal building panels. To increase the surface area and thereby enhance the adherence of sealant to the sheet 10, a woven reinforcement is impregnated in the silicone of the sheet.

The ductility and corrosion resistance of the strips 20 and 21 are also important. Aluminum having a width of about one inch and a thickness of about 0.035 to 0.040 inches has been found to be easily moldable and yet have sufficient strength between fastening points to help prevent failure of the sealant 28. It should also be noted in FIG. 4 that the extreme outer portion 38 of the edge 18 is folded over the strip 20 and bonded to the central portion 39 of the sheet 10. The strip 20 is thereby embedded in the sheet 10 to prevent water and offer atmospheric elements from reaching the strip. Preferably, however, the outer portion 38 is placed on the interior side of the flashing so that the bond used to hold the strips 20 and 21 to the sheet 10 is not critical as a seal and only needs to be effective as a means for pre-assembling the components to facilitate handling and installation. It is important, however, that the pre-assembly of the strips 20 and 21 with the sheet 10 be accomplished without puncturing the sheet 10 with such fastening means as staples or rivets, etc. By pre-assembling the elements with a bond either between outer and central portions of the sheet, or between the sheet 10 and the strips 20 and 21, the sealing capacity of the flashing system is maintained.

The flashing of the present invention is best shipped in a roll form so that extended lengths can be used to minimize the need for splicing. By using a flashing system according to the above described specifications, the weatherability of metal buildings can be greatly enhanced.

While specific embodiments of the invention have been described in detail above, variations and modifications apparent to those skilled in the art are intended to fall within the spirit and scope of the appended claims.

I claim:

1. A pre-assembled composite flashing product comprising a sheet of generally water resistant resiliently compressible material having a length significantly greater than its width, a pair of thin flat ductile strips, each strip having a width substantially greater than its thickness, to provide a place through which an elongated fastener may be driven, said strips running lengthwise at opposite edges of said sheet, each of said lengthwise edges of said sheet folded over upon itself and substantially enclosing one of said strips, whereby said product can be shaped to conform to a variety of irregular shapes, and sealingly fastened to a structure.

2. A flashing product in accordance with claim 1 wherein said sheet material includes fiber reinforcement.

3. A flashing product in accordance with claim 1 wherein said sheet material is a vapor permeable silicone rubber material.

4. A flashing product in accordance with claim 1 wherein said edges are attached to said strips by an adhesive band between said sheet and said strips.

5. A flashing product in accordance with claim 1 wherein said edges are folded over said strips such that portions of said edges reach central portions of said sheet, and said edges are adhesively bonded to said central portions.

6. A flashing product in accordance with claim 1 wherein said strips are perforated to facilitate penetration of a fastener used to install said flashing product.

7. A flashing product in accordance with claim 1 wherein said sheet material has a roughened surface to promote adherence of sealant thereto.

8. A pre-assembled composite flashing product comprising a sheet of roughened generally water resistant rubbery material having a length significantly greater than its width, said material being adhesively bondable to itself, at least two thin flat ductile strips, each strip having a width substantially greater than its thickness to provide a place through which an elongated fastener may be driven, said strips running lengthwise at opposite edges of said sheet, each of said lengthwise edges of said sheet folded over upon itself and substantially enclosing one of said strips, said sheet material having fiber reinforcement, said sheet material being resiliently compressible in order to create a seal when clamped by a head of a fastener.

9. A flashing product in accordance with claim 8 wherein said strips have preformed holes adapted to receive a shank of a headed fastener.

10. A flashing product in accordance with claim 9 wherein said strips are approximately one inch wide and 1/32 inch thick, and said strips are made of aluminum.

11. A flashing product in accordance with claim 1 wherein said sheet material has a water vapor permeability of approximately 38 grams per square meter per day.

12. A flashing system comprising, in combination, a sheet of water resistant, resiliently compressible material having a length substantially greater than its width, two thin ductile strips embedded lengthwise in opposite free edges of said sheet, each of said edges being folded over upon itself to enclose one of said strips, a plurality of headed screws adapted to fasten said sheet to a structure, said screws having shanks with drilling tips adapted to penetrate said sheet strips and structure, said screws having heads adated to compress both a portion of said material and portions of said strips upon tightening of said screw to create a seal at said head to prevent entry of water into said structure at points where said screws penetrate said sheet, strips and structure.

* * * * *